US006707431B2

(12) United States Patent
Byun et al.

(10) Patent No.: US 6,707,431 B2
(45) Date of Patent: Mar. 16, 2004

(54) DUAL ANTENNA CAPABLE OF CONTROLLING RADIATION CHARACTERISTICS IN A MOBILE COMMUNICATION TERMINAL

(75) Inventors: Joon-Ho Byun, Suwon (KR); Juh-Hyung Lee, Kwachon (KR); Byoung-Man Lim, Seoul (KR); Seon-Kyeong Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/192,348

(22) Filed: Jul. 10, 2002

(65) Prior Publication Data

US 2003/0016178 A1 Jan. 23, 2003

(30) Foreign Application Priority Data

Jul. 20, 2001 (KR) ..... 2001-43729
Sep. 21, 2001 (KR) ..... 2001-58697

(51) Int. Cl.[7] ..... H01Q 1/24
(52) U.S. Cl. ..... 343/702; 343/700 MS; 343/880
(58) Field of Search ..... 343/702, 700 MS, 343/846, 880, 881, 882; 455/89, 90

(56) References Cited

U.S. PATENT DOCUMENTS 5,451,965 A 9/1995 Matsumoto ..... 343/702
5,990,839 A * 11/1999 Schefte et al. ..... 343/702

FOREIGN PATENT DOCUMENTS

EP 0 543 645 A1 11/1992 ..... H01Q/1/24
EP 0 895 299 A1 2/1999 ..... H01Q/1/24
EP 1 109 247 A1 6/2001 ..... H01Q/1/24
EP 1 211 749 A1 11/2001 ..... H01Q/1/24
JP 2000-068729 A 3/2000 ..... H01Q/1/24

OTHER PUBLICATIONS

European Search Report dated Feb. 3, 2003, issued in a counterpart application, namely, Appln. No. 02016426.5.
"Realization of a Printed–On–Display Antenna for Mobile Terminals", 2001 IEEE Antennas and Propagation Society International Symposium and USNC/URSI National Radio Science Meeting, pps. 1–4.

* cited by examiner

*Primary Examiner*—Hoang V. Nguyen
(74) *Attorney, Agent, or Firm*—Dilworth & Barrese LLP

(57) ABSTRACT

A dual antenna capable of controlling a radiation characteristic in a folder type mobile communication terminal. The dual antenna comprises a first directional antenna mounted on a folder of the mobile communication terminal, and a second directional antenna mounted on a body of the mobile communication terminal. In a suspended state where the folder is folded against the body, the first and second directional antennas have directivities in an opposite direction. However, in a call state where the folder is unfolded away from the body, the first and second directional antennas have directivities in the same direction. Preferably, the first directional antenna is mounted on a rear side of the body of the mobile communication terminal, and the second directional antenna is mounted on an outer side of the folder of the mobile communication terminal.

19 Claims, 13 Drawing Sheets

DUAL ANTENNA CAPABLE OF CONTROLLING RADIATION CHARACTERISTICS IN A MOBILE COMMUNICATION TERMINAL

PRIORITY

This application claims priority to an application entitled "Dual Antenna Capable of Controlling Radiation Characteristics in a Mobile Communication Terminal" filed in the Korean Industrial Property Office on Jul. 20, 2001 and assigned Serial No. 2001-43729, and an application entitled "Dual Antenna Capable of Controlling Radiation Characteristics in a Mobile Communication Terminal" filed in the Korean Industrial Property Office on Sep. 21, 2001 and assigned Serial No. 2001-58697, the contents of both of which are incorporated herein by reference.

BACKGROUND OF THE INVENTION

1. Field of the Invention

The present invention relates generally to an antenna for a mobile communication terminal such as a mobile phone, and in particular, to a dual antenna capable of controlling radiation characteristics in a mobile communication terminal. The mobile communication terminal, preferably, a folder type (or dual-LCD (Liquid Crystal Display) folder type) mobile communication terminal, has two directional antennas—one is mounted on a folder and another on a body of the mobile communication terminal such that the radiation characteristics are separately controlled in a suspended state where the folder is folded toward the body and a call state where the folder is unfolded away from the body, contributing to an improvement in antenna performance and a reduction in electromagnetic waves that radiate toward a user's head.

2. Description of the Related Art

In general, a mobile communication terminal employs an omni-directional, retractable antenna to support duplex transmission and secure portability. A conventional mobile communication terminal has two separate antennas—one is used in a suspended state and another in a call state. The antennas are designed to easily receive and transmit linearly polarized signals. Typically, a spring-shaped helical antenna is mounted on an upper end of the mobile communication terminal. The helical antenna is advantageous in that it enables a call regardless of the direction in which the mobile communication terminal is placed. Further, a monopole-type retractable whip antenna shows better performance than the helical antenna in a state where the mobile communication terminal (or the whip antenna) stands at right angles to the ground. Ideally, however, it is known that when the whip antenna is kept horizontal to the ground, it cannot receive signals. The isotropic (or omni-directional) helix/whip combined antenna of FIGS. 1 and 2 is mounted on an upper end of the mobile communication terminal, as illustrated in FIG. 3.

FIGS. 4A and 4B illustrate an equivalent circuit of the isotropic helix/whip combined antenna. Since the combined antenna is isotropic, it has the omni-directional radiation characteristics centering on a mobile communication terminal 412 as represented by a circle 411 of FIGS. 4A and 4B, causing radiation of electromagnetic waves toward a head of the user during a call. The isotropic combined antenna has a good radiation characteristic when it is spaced apart from the head of the user. However, when it comes close to the head of the user, an amount of the electromagnetic waves absorbed into the user's head is increased, resulting in a reduction in antenna performance and an increase in SAR (Specific Absorption Rate) representing a degree of the influence of electromagnetic waves on the human body. Accordingly, mobile phone makers and antenna makers are investing a lot of money and manpower in developing an improved antenna capable of preventing the electromagnetic waves from being radiated toward the head of the user. As an alternative, a scheme for radiating most of the electromagnetic waves at the rear of the mobile phone has been proposed. To accomplish this, a patch antenna or a PIFA (Planar Inverted-F Antenna) antenna is typically mounted on an upper end of the rear side of the mobile phone. The antenna prevents the electromagnetic waves from being radiated in the front of the mobile phone, i.e., toward the human body, resulting in an improvement in call quality and a reduction in SAR when it approach the user's head. However, when it is spaced apart from the user's head, the antenna may not properly receive waves from a specific direction, thus deteriorating performance of the mobile phone. In this case, the electromagnetic waves radiated in the front of the mobile phone are deceased, whereas the electromagnetic waves radiated in the rear of the mobile phone are increased. Accordingly, when the user talks over the mobile phone with the phone put in his or her pocket, damages caused by the electromagnetic waves may increase undesirably.

SUMMARY OF THE INVENTION

It is, therefore, an object of the present invention to provide a dual antenna capable of minimizing the influence of electromagnetic waves on the human body without performance reduction, by separately controlling two antennas mounted on a mobile phone in a call state and a suspended state.

It is another object of the present invention to provide a dual antenna with improved performance in a folder type mobile communication terminal, wherein two antennas have directivities, i.e. radiate and receive signals, in the same direction to reduce electromagnetic waves radiated toward a user's head in a call state where a folder is unfolded while the two antennas have directivities in an opposite direction to make the overall directivity omni-directional thus to increasing performance in a suspended state where the folder is folded.

It is further another object of the present invention to provide a dual antenna capable of minimizing the influence of electromagnetic waves on the human body without performance reduction by mounting two patch antennas on the rear of a body of a dual-LCD folder type mobile communication terminal and an outer widow of the dual-LCD folder, respectively.

According to one aspect of the present invention, there is provided a dual antenna capable of controlling a radiation characteristic in a folder type mobile communication terminal. The dual antenna comprises a first directional antenna mounted on a folder of the mobile communication terminal, and a second directional antenna mounted on a body of the mobile communication terminal. In a suspended state where the folder is folded against the body, the first and second directional antennas have directivities in an opposite direction. However, in a call state where the folder is unfolded away from the body, the first and second directional antennas have directivities in the same direction.

Preferably, the second directional antenna is mounted on a rear side of the body of the mobile communication terminal, and the first directional antenna is mounted on an outer side of the folder of the mobile communication terminal.

Preferably, the first and second directional antennas are each comprised of a microstrip patch.

According to another aspect of the present invention, there is provided a dual antenna capable of controlling a radiation characteristic in a dual-LCD (Liquid Crystal Display) folder type mobile communication terminal with a dual-LCD folder and a body. The dual antenna comprises a first directional antenna mounted on the dual-LCD folder, and a second directional antenna mounted on the body. In a suspended state, the first and second directional antennas have directivities in an opposite direction. However, in a call state, the first and second directional antennas have directivities in the same direction.

Preferably, the first directional antenna is a POD (Printed-On-Display) antenna. Further, the POD antenna is mounted on an outer window of the dual-LCD folder.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
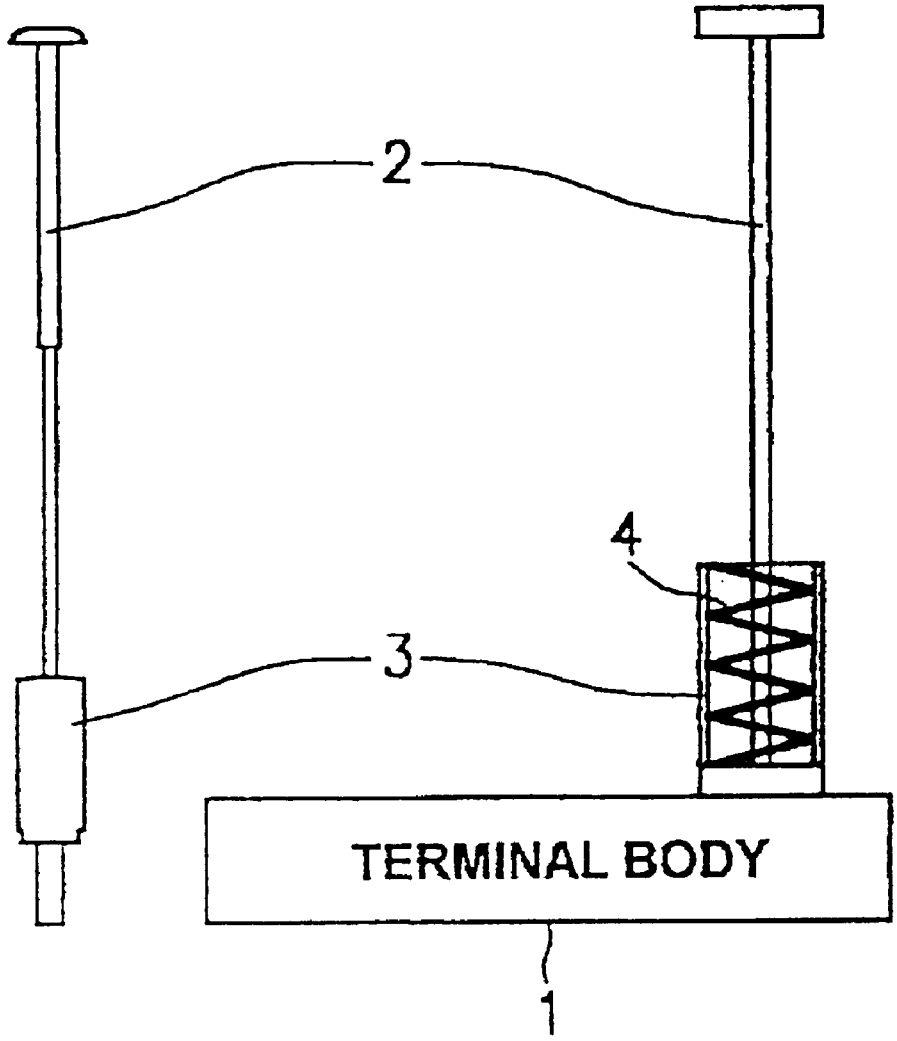
FIG. 1 (PRIOR ART)
FIGS. 1 and 2 illustrate general helical and whip antennas, wherein the helical antenna is coupled to an end of the whip antenna.
Figure 2:
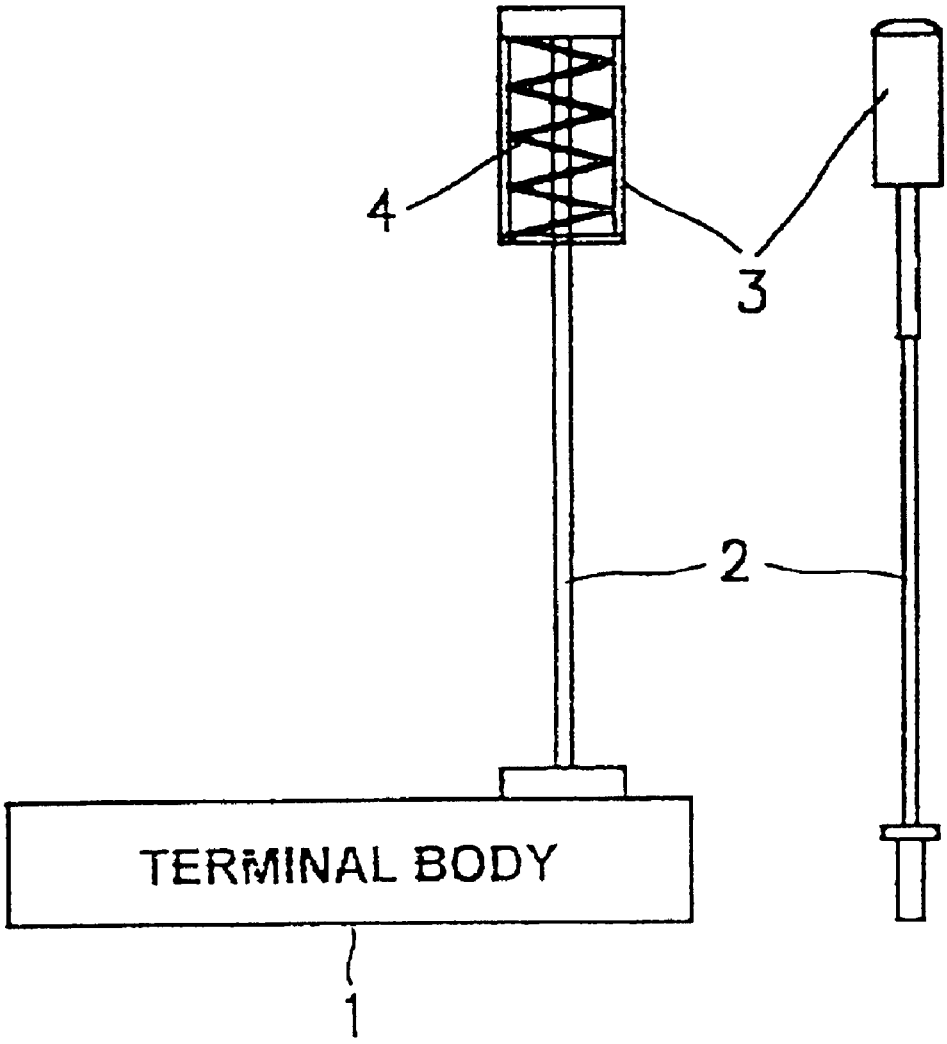
FIG. 2 (PRIOR ART)
Figure 3:
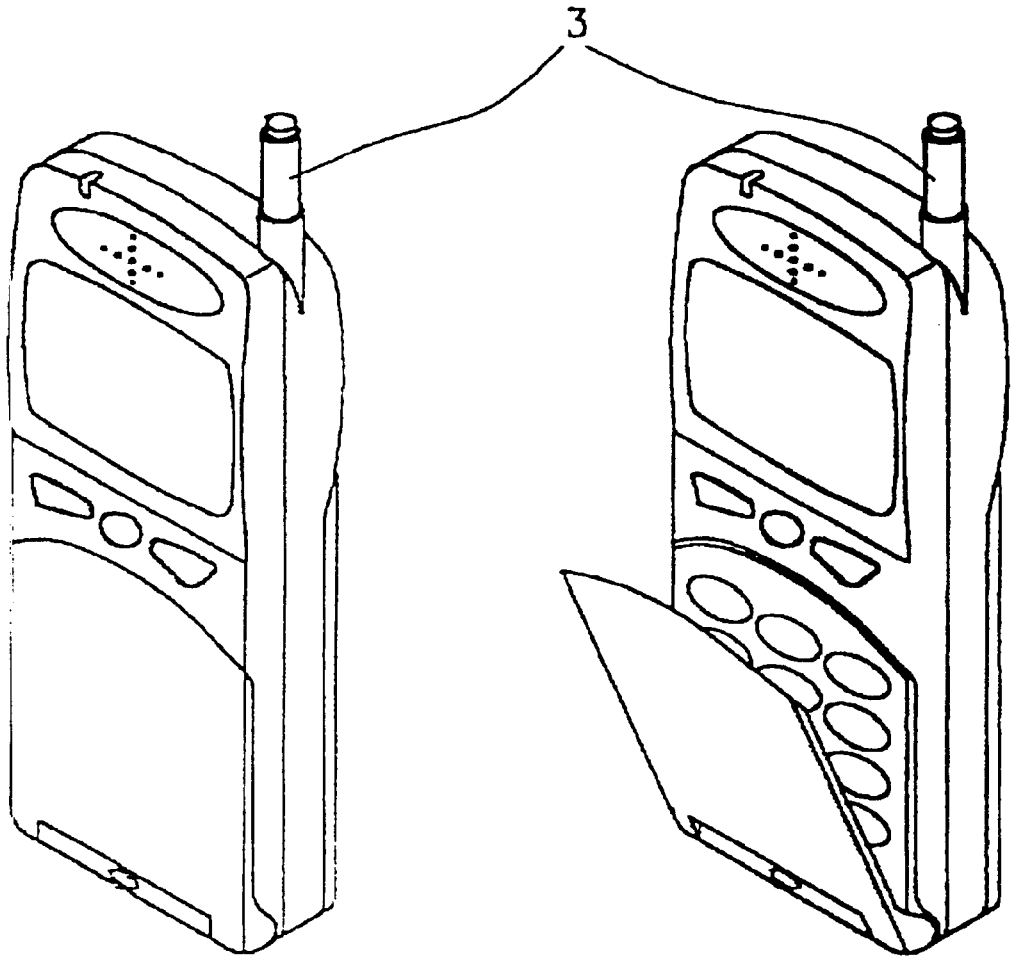
FIG. 3 (PRIOR ART)
FIG. 3 illustrates general helical and whip antennas, wherein the helical antenna is coupled to a body of a flip type mobile communication terminal.
Figure 4A:
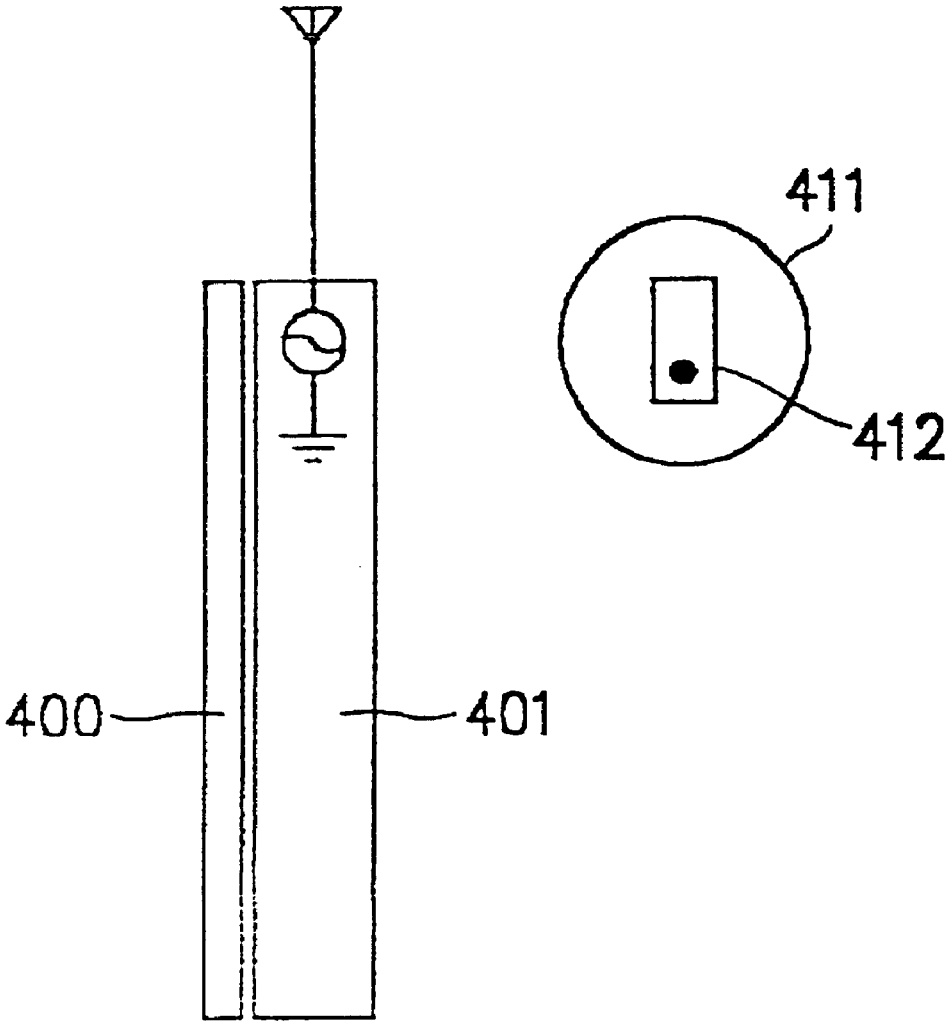
FIG. 4A (PRIOR ART)
FIGS. 4A and 4B illustrate an equivalent circuit of an antenna in a folder type mobile communication terminal with conventional helical and whip antennas, and also illustrate a radiation pattern in an azimuth pattern according to whether a folder is folded or unfolded.
Figure 4B:
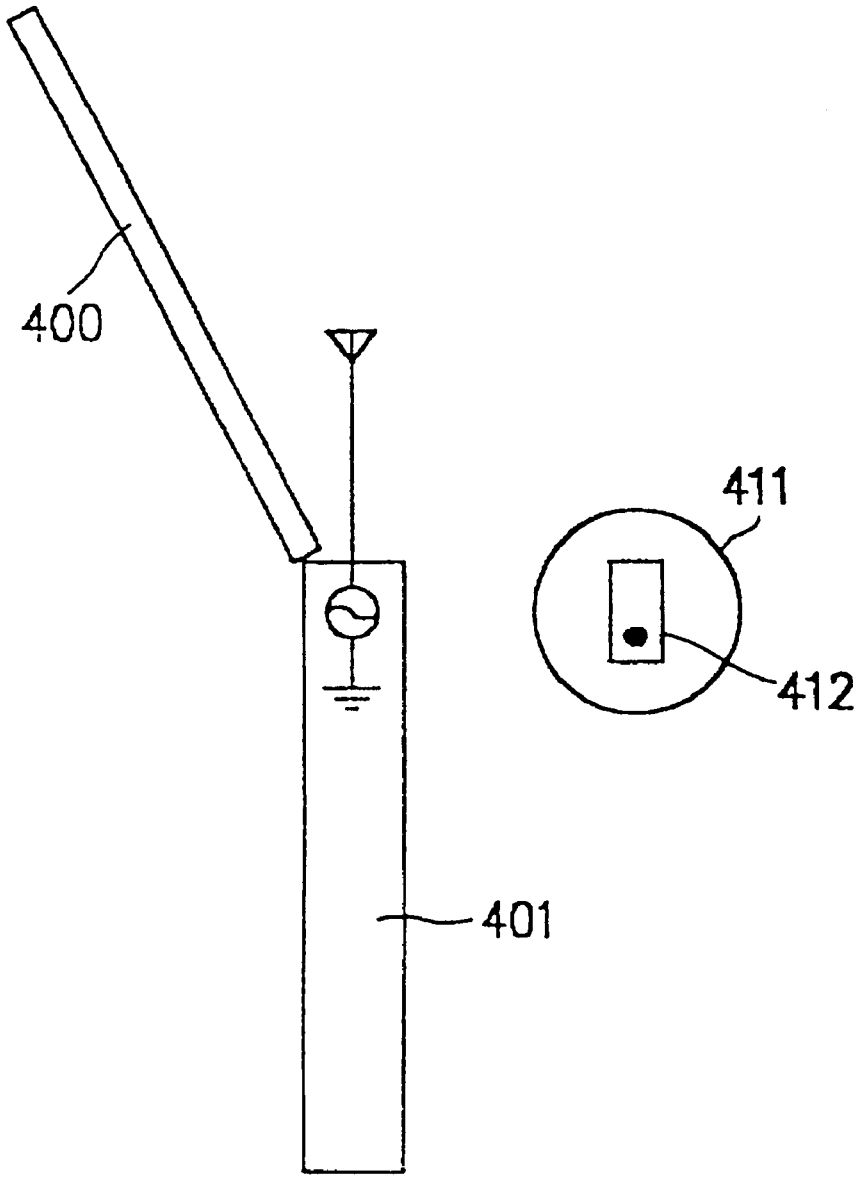
FIG. 4B (PRIOR ART)
Figure 5A:
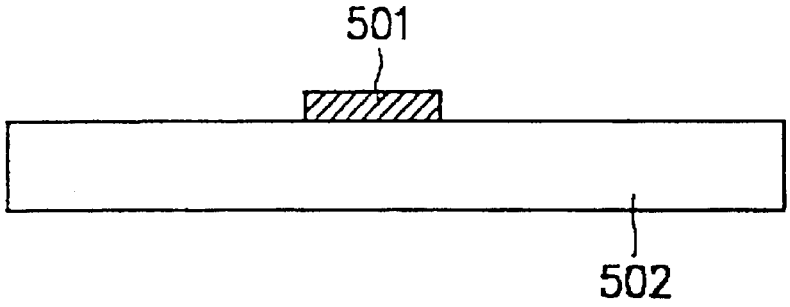
FIGS. 5A and 5B illustrate directional antennas comprised of a microstrip patch according to an embodiment of the present invention.
Figure 5B:
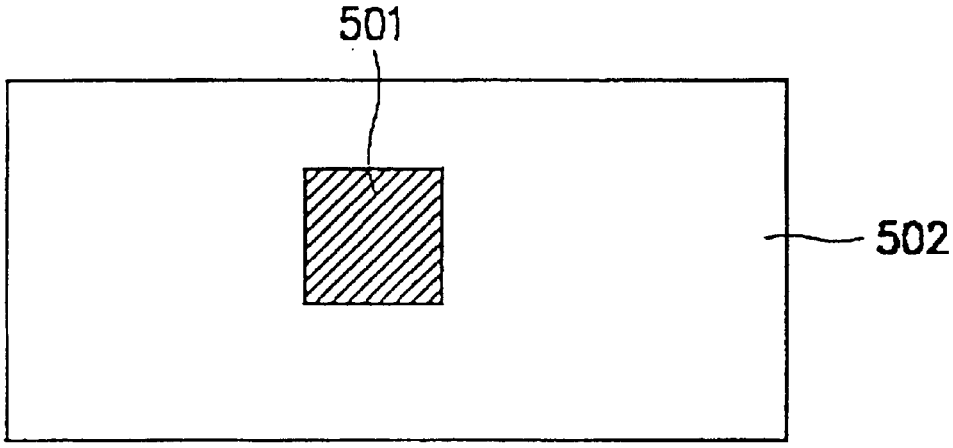

FIGS. 5A and 5B illustrate first and second directional antennas each comprised of a microstrip patch according to an embodiment of the present invention. Specifically, FIG. 5A is a side view of a microstrip patch antenna mounted on the front side of a folder 400 or the rear side of a body 401 in FIGS. 4A and 4B. FIG. 5B is a plane view of the microstrip patch antenna mounted on the front side of the folder 400 or the rear side of the body 401.

In FIGS. 5A and 5B, reference numeral 502 represents a substrate having a predetermined dielectric constant, and reference numeral 501 represents a microstrip line made of high-conductivity material. The microstrip patch antenna is advantageous in that it does not have space limitation. Ferrite and air or composite material thereof can be used as dielectrics for, the substrate 502. In addition, a multi-layered substrate can also be used as the substrate 502.

Figure 6A:
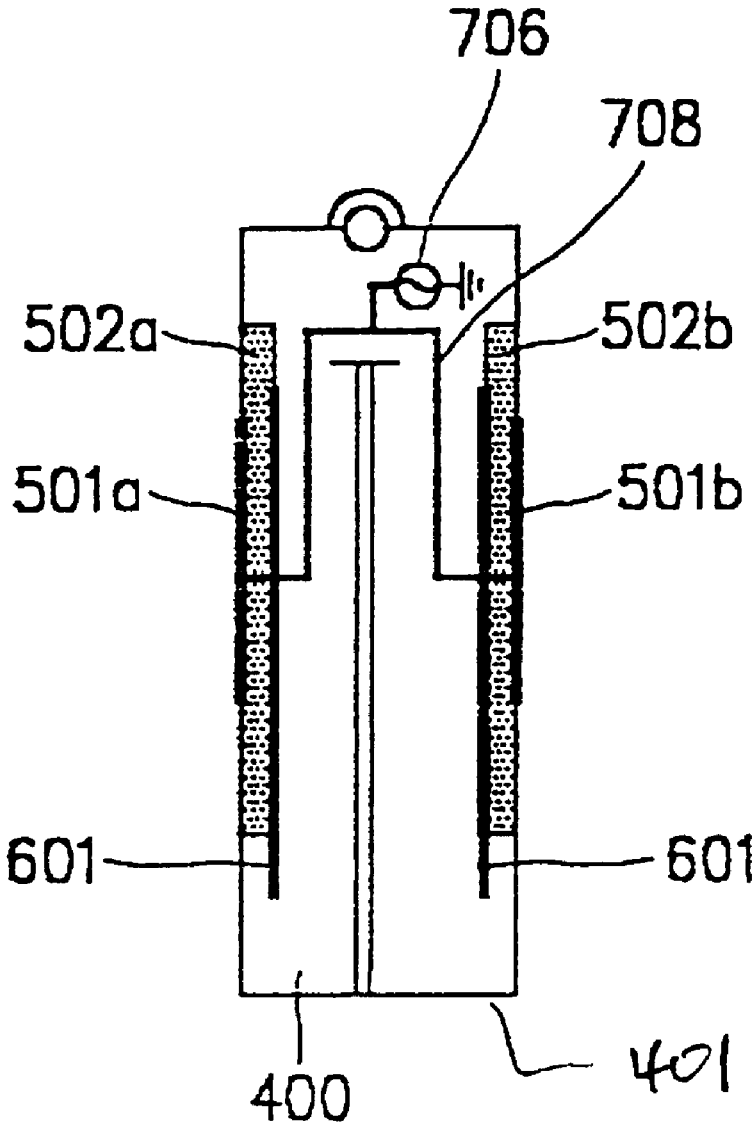
FIGS. 6A and 6B illustrate a folder type mobile communication terminal with the direction antennas of FIGS. 5A and 5B mounted respectively on a folder and a body thereof.
Figure 6B:
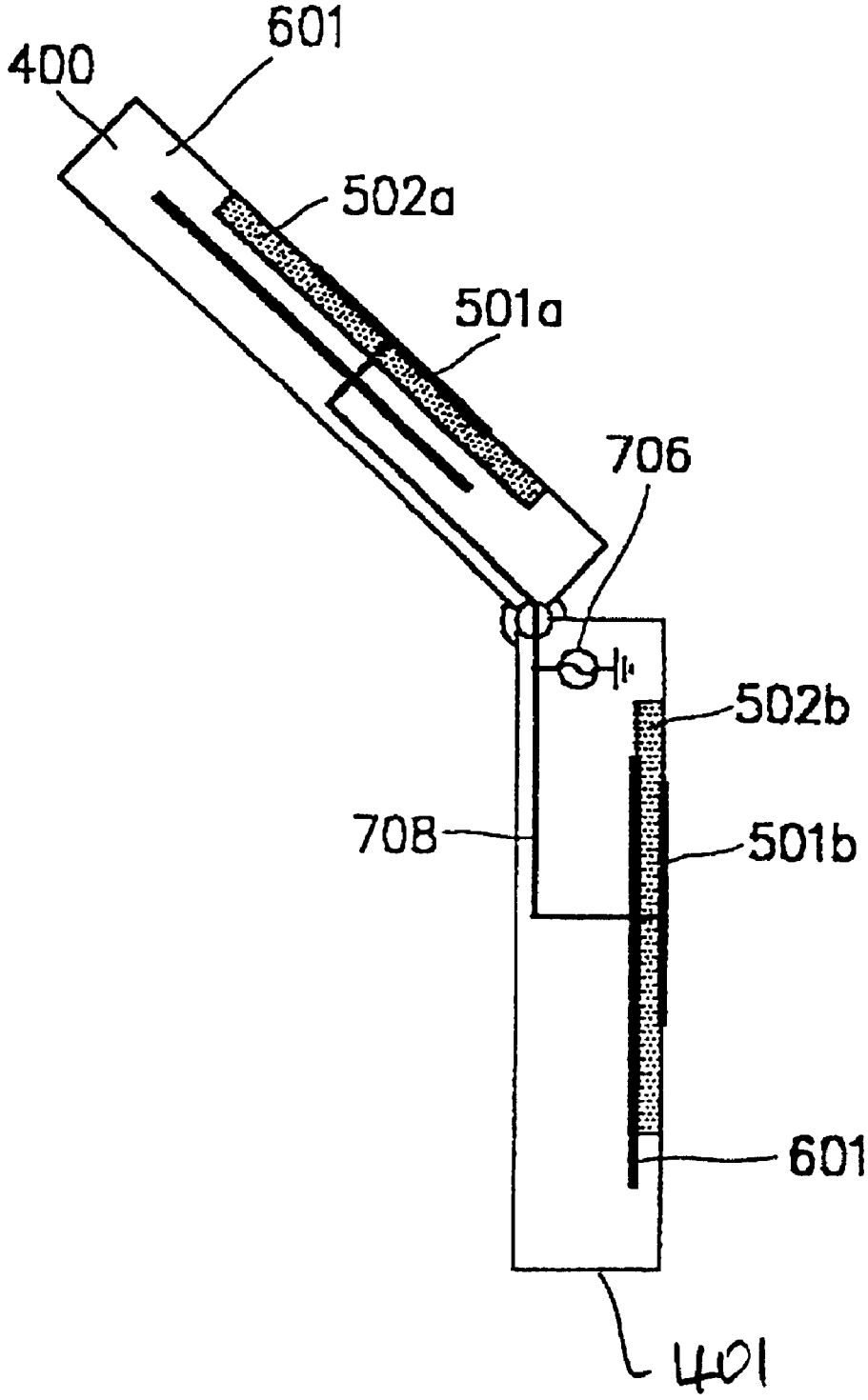

FIGS. 6A and 6B illustrate a folder type mobile communication terminal with the microstrip patch antennas of FIGS. 5A and 5B mounted respectively on a folder 400 and a body 401 thereof. Specifically, FIG. 6A illustrates a suspended state where the folder 400 is folded against the body 401, and FIG. 6B illustrates a call state where the folder 400 is unfolded away from the body 401. In FIGS. 6A and 6B, reference numerals 501*a* and 501*b* represent microstrip lines of the microstrip patch antennas, and reference numerals 502*a* and 502*b* represent dielectric substrates. Further, reference numeral 601 represents a PCB (printed circuit board) on which electronic circuits of the folder 400 and the body 401 are arranged. The microstrip patch antennas mounted on the folder 400 and the body 401 are connected to the electronic circuits on the PCB 601. In addition, reference numeral 706 represents a feeding point.

Figure 7A:
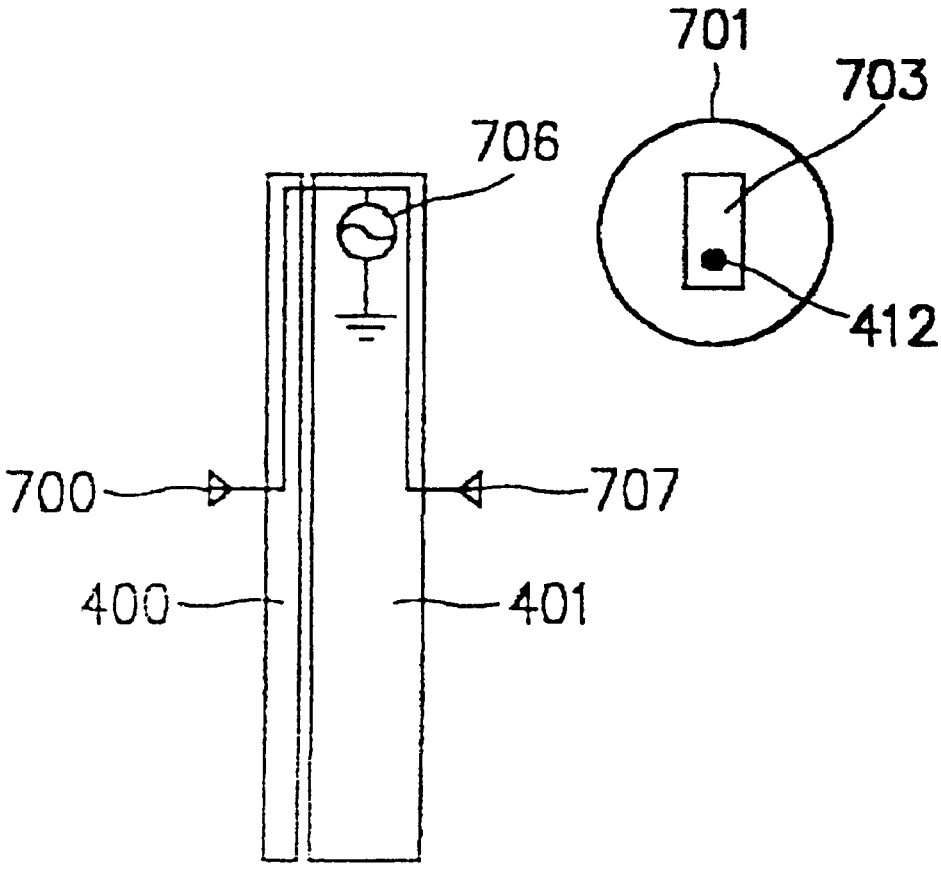
FIGS. 7A and 7B illustrate an equivalent circuit of the directional antennas in a folder type mobile communication terminal according to an embodiment of the present invention.
Figure 7B:
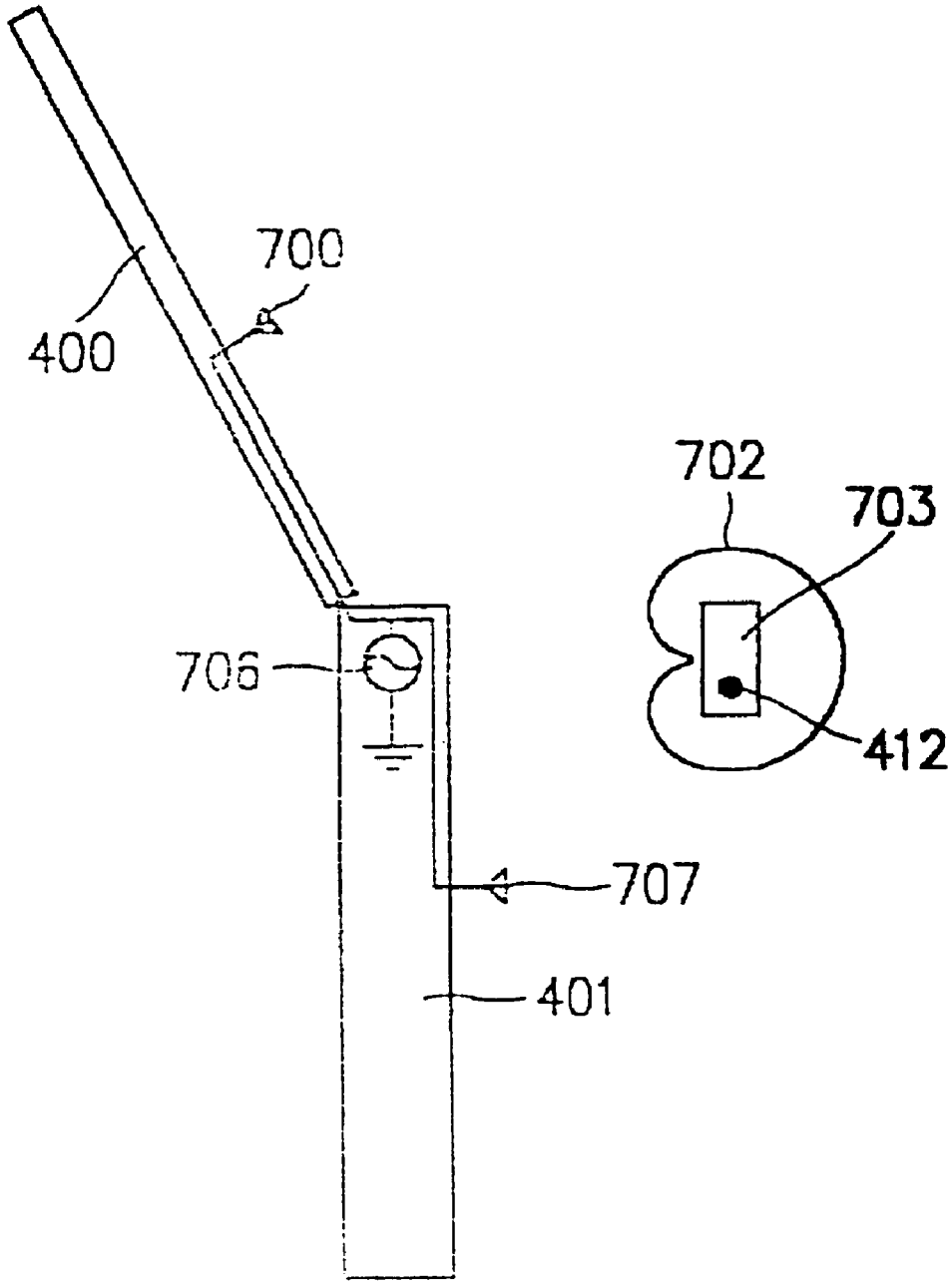

FIGS. 7A and 7B illustrate a folder type mobile communication terminal with first and second directional antennas mounted respectively on a folder 400 and a body 401 according to an embodiment of the present invention, and its equivalent circuit. Specifically, FIG. 7A illustrates a suspended state where the folder 400 is folded against the body 401 of the mobile communication terminal, wherein the two directional antennas have directivities in the opposite direction, thus providing an omni-directional radiation characteristic 701. FIG. 7B illustrates a call state where the folder 400 is unfolded away from the body 401 of the mobile communication terminal, wherein the first and second directional antennas have directivities in the same direction, providing a directional radiation characteristic 702, so that the electromagnetic waves radiated toward the user's head are remarkably decreased.

In the suspended state of FIG. 7A, the mobile communication terminal maintains the omni-directional radiation characteristic 701 like the conventional mobile communication terminal of FIG. 4A. However, in the call state of FIG. 7B where the user unfolds the folder 400 to make or answer a call, the mobile communication terminal has the directional radiation characteristic 702, thus making it possible to reduce electromagnetic waves absorbed into the user's body during the call.

Therefore, unlike the conventional mobile communication terminal illustrated in FIGS. 4A and 4B, the mobile communication terminal according to the present invention has the first and second directional microstrip patch antennas mounted respectively on the folder 400 and the body 401. The two antennas have directivities in the same direction or opposite direction according to whether the folder 400 is folded against or unfolded away from the body 401. To be specific, the antennas have directivities in the opposite direction in the suspended state, thus securing the omni-directional radiation characteristic 701, and have directivities in the same direction in the call state, thus providing the directional radiation characteristic 702.

Figure 8:
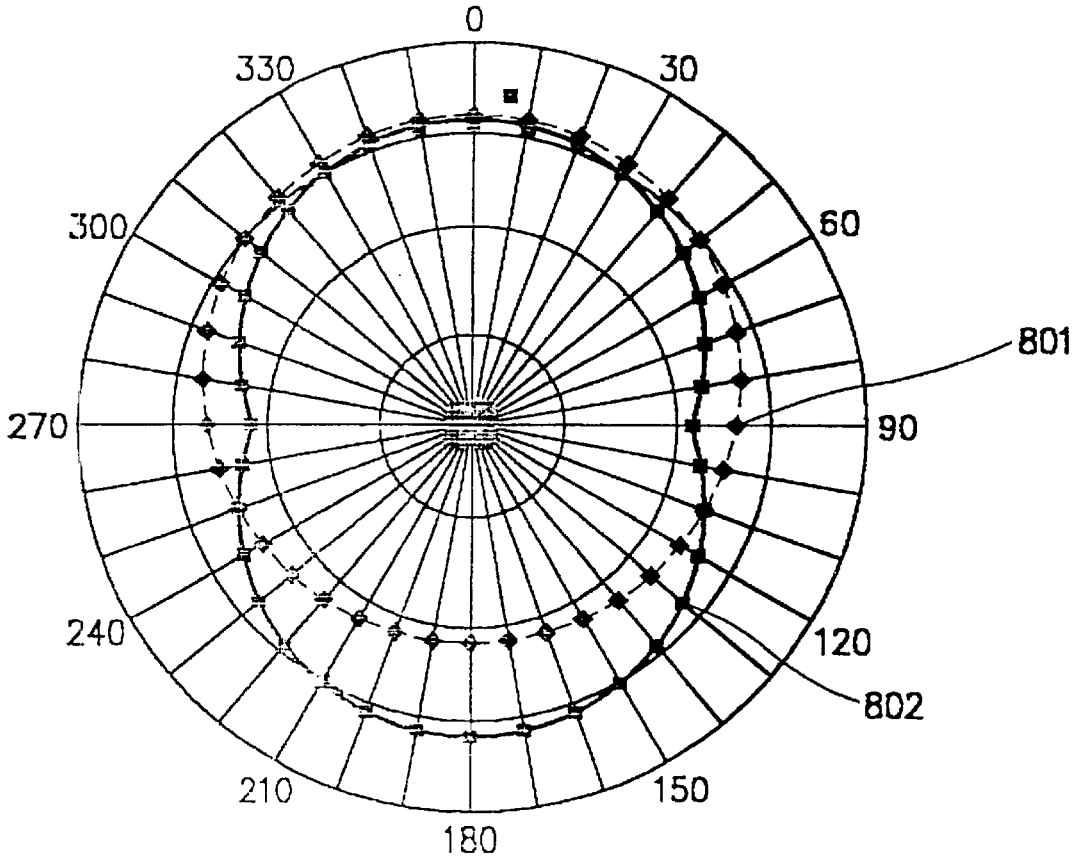
FIG. 8 illustrates a radiation pattern in an azimuth pattern depending on whether a folder is folded or unfolded according to an embodiment of the present invention.

FIG. 8 illustrates a change in the radiation characteristics when the folder 400 is folded against and unfolded away from the body 401. Reference numeral 801 represents a radiation pattern when the folder 400 is unfolded, and reference numeral 802 represents a radiation pattern when the folder is folded. When the folder 400 is folded, the radiation pattern becomes omni-directional, so the antennas have the same radiation characteristics as the conventional antennas. However, when the folder 401 is unfolded, the electromagnetic waves radiated toward the user's head are reduced, thus contributing to a decrease in SAR representing an amount of electromagnetic waves absorbed into the user's head. The first and second directional microstrip patch antennas 501*a* and 501*b* show a first directional antenna characteristic and a second directional antenna characteristic centering on the folder 400 and the body 401, respectively.

In the suspended state illustrated in FIG. 7A where the folder 400 is folded, the antennas 700 and 707 comprised of the microstrip path antennas 501*a* and 501*b* have directivities in the opposite direction, thus providing omni-directional radiation characteristics like the conventional omni-directional antennas.

However, in the call state illustrated in FIG. 7B where the folder 400 is unfolded away from the body 401 at a specific angle, the antennas 700 and 707 comprised of microstrip patch antennas 501*a* and 501*b* have directivities in the same direction, thus providing directional radiation characteristics. Therefore, the electromagnetic waves radiated toward the user's head are reduced as represented by reference numeral 702 of FIG. 7B.

Another embodiment of the present invention will be described with reference to FIGS. 9 and 10.

Figure 9:
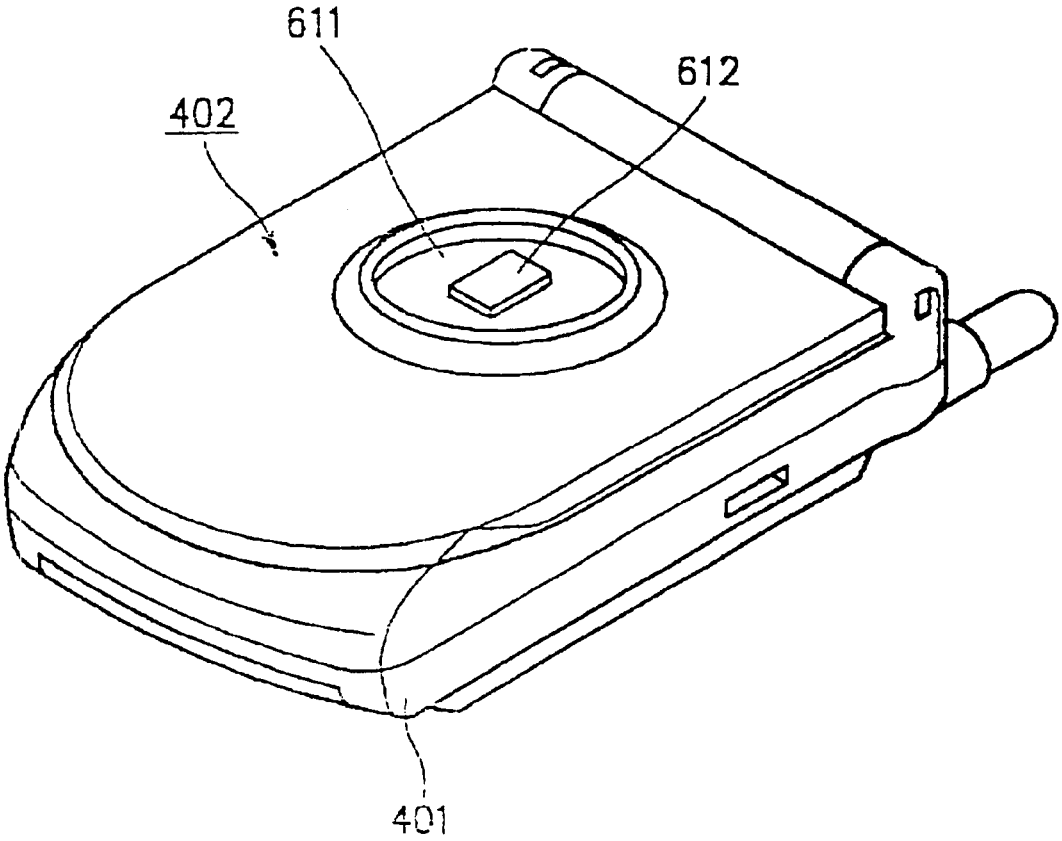
FIGS. 9 and 10 illustrate a dual-LCD folder type mobile communication terminal with directional antennas according to another embodiment of the present invention.
Figure 10:
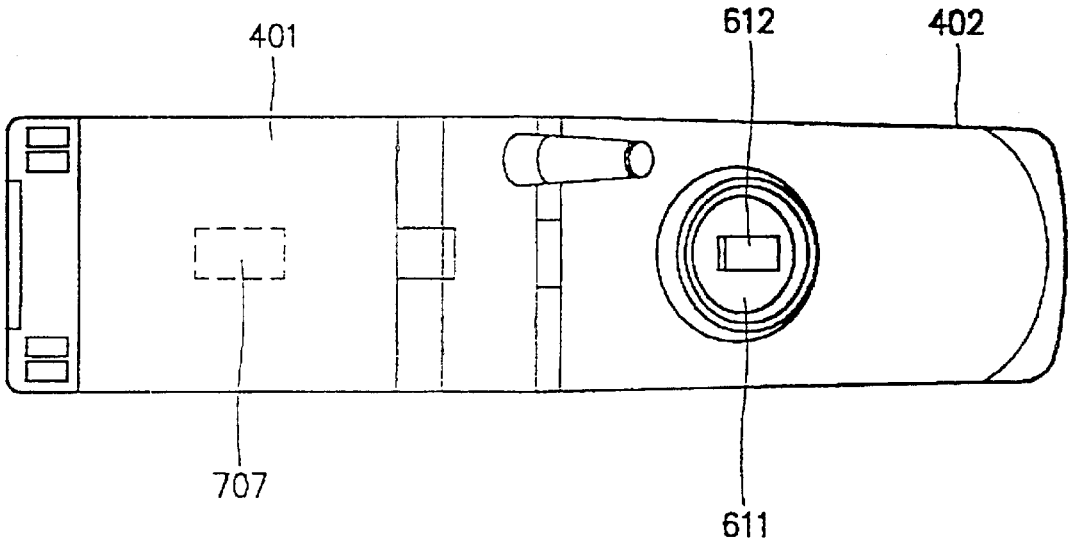

FIG. 9 illustrates a dual-LCD folder type mobile communication terminal with a separate window 611 formed on an outer side of a dual-LCD folder 402. The body 401 has the microstrip patch antenna 501*b* of FIGS. 5A and 5B mounted on the rear side thereof, whereas the dual-LCD folder 402 has a POD (Printed-On-Display) antenna 612 mounted on the LCD window 611. The POD antenna 612 is made of ITO (Indium oxide doped with Thin Oxide), which is electrically conductive and optically transparent. The POD antenna 612 is well disclosed in a pager "Realization of a Printed-On-Display Antenna for Mobile Terminals", Antennas and Propagation Society International Symposium and UNSNC/URSI National Radio Science Meeting, 2001 IEEE. According to the pager, the POD antenna is designed to replace the conventional helical or monopole antenna, and to support both the display function and the antenna function. Further, the POD antenna is designed to make up for the mechanical drawback of the conventional antenna. Also in this embodiment, when the dual body 401 with the microstrip patch antenna 501*b*, the two antennas have directivities in the opposite direction, providing omni-directional radiation characteristics. However, when the dual-LCD folder 402 is unfolded away from the body 401, the two antennas have directivities in the same direction, providing radiation characteristics such that the electromagnetic waves are radiated in an opposite direction of the user's head.

As described above, the antennas have different radiation patterns according to whether the folder (or dual-LCD folder) is folded or unfolded. Specifically, in the call state where the folder is unfolded, the two antennas have directional radiation characteristics so that the electromagnetic waves radiated toward the user's head are reduced. In the suspended state where the folder is folded, the two antennas have directivities in the opposite direction, thus providing omni-directional radiation characteristics so that the mobile communication terminal correctly receives signals.

While the invention has been shown and described with reference to a certain preferred embodiment thereof, it will be understood by those skilled in the art that various changes in form and details may be made therein without departing from the spirit and scope of the invention as defined by the appended claims.

What is claimed is:

1. A dual antenna capable of controlling a radiation characteristic in a mobile communication terminal, comprising:

at least two directional antennas mounted on the mobile communication terminal, one of said directional antennas being mounted on a body of the mobile terminal;

wherein in a suspended state, the directional antennas have directivities in an opposite direction; and wherein in a call state, the directional antennas have directivities in a same direction.

2. The dual antenna of claim 1, wherein in the suspended state, the directional antennas have omni-directional radiation characteristics.

3. The dual antenna of claim 1, wherein in the call state, the directional antennas have directional radiation characteristics so that electromagnetic waves radiated to a user's head are reduced.

4. A dual antenna capable of controlling a radiation characteristic in a folder type mobile communication terminal, comprising:

a first directional antenna mounted on a folder of the mobile communication terminal; and a second directional antenna mounted on a body of the mobile communication terminal;

wherein in a suspended state, the first and second directional antennas have directivities in an opposite direction; and wherein in a call state, the first and second directional antennas have directivities in a same direction.

5. The dual antenna of claim 4, wherein the second directional antenna is mounted on a rear side of the body of the mobile communication terminal.

6. The dual antenna of claim 4, wherein the first directional antenna is mounted on an outer side of the folder of the mobile communication terminal.

7. The dual antenna of claim 4, wherein the first and second directional antennas are each comprised of a microstrip patch.

8. The dual antenna of claim 4, wherein the first and second directional antennas are each comprised of a conductive microstrip plate and a substrate with a given dielectric constant formed on the microstrip plate.

9. The dual antenna of claim 8, wherein the substrate is comprised of ferrite and air.

10. The dual antenna of claim 8, wherein the substrate is a multi-layered substrate.

11. The dual antenna of claim 8, wherein the substrate is comprised of a composite material of ferrite and air.

12. The dual antenna of claim 4, wherein in the suspended state, the directional antennas have omni-directional radiation characteristics.

13. The dual antenna of claim 4, wherein in the call state, the directional antennas have directional radiation characteristics.

14. A dual antenna capable of controlling a radiation characteristic in a dual-LCD (Liquid Crystal Display) folder type mobile communication terminal with a dual-LCD folder and a body, comprising:

a first directional antenna mounted on the dual-LCD folder; and a second directional antenna mounted on the body;

wherein in a suspended state, the first and second directional antennas have directivities in an opposite direction;

wherein in a call state, the first and second directional antennas have directivities in a same direction.

15. The dual antenna of claim 14, wherein the first directional antenna is a POD (Printed-On-Display) antenna.

16. The dual antenna of claim 15, wherein the POD antenna is mounted on an outer window of the dual-LCD folder.

17. The dual antenna of claim 14, wherein in the suspended state, the directional antennas have omni-directional radiation characteristics.

18. The dual antenna of claim 14, wherein in the call state, the directional antennas have directional radiation characteristics.

19. A dual antenna capable of controlling a radiation characteristic in a mobile communication terminal, comprising:

at least two directional antennas mounted on the mobile communication terminal;

wherein in a suspended state, the directional antennas have omni-directional radiation characteristics; and wherein in a call state, the directional antennas have directional radiation characteristics.

* * * * *